US005107276A

United States Patent [19]

Kneezel et al.

[11] Patent Number: 5,107,276

[45] Date of Patent: Apr. 21, 1992

[54] THERMAL INK JET PRINTHEAD WITH CONSTANT OPERATING TEMPERATURE

[75] Inventors: Gary A. Kneezel, Webster; Thomas A. Tellier, Williamson; Richard V. LaDonna, Fairport, all of N.Y.

[73] Assignee: Xerox Corporation, Stamford, Conn.

[21] Appl. No.: 572,075

[22] Filed: Aug. 24, 1990

Related U.S. Application Data

[63] Continuation-in-part of Ser. No. 375,162, Jul. 3, 1989, abandoned.

[51] Int. Cl.[5] ..... B41J 2/05

[52] U.S. Cl. ..... 346/1.1; 346/140 R

[58] Field of Search ..... 346/140, 1.1

[56] References Cited

U.S. PATENT DOCUMENTS

| | | | |
|---|---|---|---|
| Re. 32,572 | 1/1988 | Hawkins et al. | 156/626 |
| 4,326,206 | 4/1982 | Raschke | 346/140 |
| 4,350,989 | 9/1982 | Sagae et al. | 346/140 |
| 4,490,728 | 12/1984 | Vaught et al. | 346/1.1 |
| 4,499,479 | 2/1985 | Chee-Shuen Lee et al. | 346/140 |
| 4,532,530 | 7/1985 | Hawkins | 346/140 |
| 4,536,774 | 8/1985 | Inui et al. | 346/76 |
| 4,566,813 | 1/1986 | Kobayashi et al. | 400/120 |
| 4,571,599 | 2/1986 | Rezanka | 346/140 |
| 4,712,172 | 12/1987 | Kiyohara et al. | 346/1.1 |
| 4,712,930 | 12/1987 | Maruno et al. | 400/120 |
| 4,719,472 | 1/1988 | Arakawa | 346/140 |
| 4,791,435 | 12/1988 | Smith et al. | 346/140 |
| 4,910,528 | 3/1990 | Firl et al. | 346/1.1 |

*Primary Examiner*—Joseph W. Hartary
*Attorney, Agent, or Firm*—Robert A. Chittum

[57] ABSTRACT

A thermal ink jet printer is disclosed which has a printhead that is maintained at a substantially constant operating temperature during printing. Printing on demand is accomplished by the ejection of ink droplets from the printhead nozzles in response to energy pulses selectively applied to heating elements located in ink channels upstream from the nozzles which pulses vaporize the ink to form temporary bubbles. To prevent printhead temperature fluctuations during printing, especially in translatable carriage printers, the heating elements not being used to eject droplets are selectively energized with energy pulses having insufficient magnitude to vaporize the ink.

23 Claims, 10 Drawing Sheets

THERMAL INK JET PRINTHEAD WITH CONSTANT OPERATING TEMPERATURE

BACKGROUND OF THE INVENTION

1. Field of the Invention

This application is a continuation-in-part application of the application Ser. No. 07/375,162 filed Jul. 3, 1989 now abandoned.

This invention relates to thermal ink jet printing devices and, more particularly, to improved printheads which are maintained at a constant operating temperature so that droplet or pixel size does not vary with temperature.

2. Description of the Prior Art

Thermal ink jet printing is generally a drop-on-demand type of ink jet printing which uses thermal energy to produce a vapor bubble in an ink-filled channel that expels a droplet. A thermal energy generator or heating element, usually a resistor, is located in the channels near the nozzle a predetermined distance therefrom. The resistors are individually addressed with an electrical pulse to momentarily vaporize the ink and form a bubble which expels an ink droplet. As the bubble grows, the ink bulges from the nozzle and is contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separating of the bulging ink as a droplet. The acceleration of the ink out of the nozzle while the bubble is growing provides the momentum and velocity of the droplet in a substantially straight line direction towards a recording medium, such as paper.

Thus, thermal ink jet devices operate by pulsing heating elements in contact with ink so that bubbles are nucleated, ejecting ink droplets toward the paper. It has been found during print tests that print quality is affected as the device heats up. In particular, if the device heats up too high (e.g., during extended high density printing), then it tends to lose prime, and one or more ink channels of the printhead cease to expel droplets. A less catastrophic defect, but still one that degrades print quality, is the increase in printed spot or pixel size as a function of device temperature. Through study of this phenomenon, it has been found that both the mass and velocity of the droplet increase with device temperature and that both the mass and velocity contribute to increased pixel size on the paper. For the carriage type ink jet printer with sufficiently high printing density, the spot size increases as the carriage traverses the page. Then as it pauses at the end of travel and reverses direction, it cools slightly, so that the next line or swath printed on the way back has increasing pixel sizes in the opposite direction. This gives rise to light and dark bands, which are most pronounced at the edges of the paper. Similarly, other patterns of high and low density printing are degraded by the increase in pixel size with device temperature.

Many of the prior art devices incorporate a heat sink of sufficient thermal mass and of low enough thermal resistance that the device temperature does not rise excessively. For one example of a thermal ink jet printhead having a heat sink, refer to U.S. Pat. No. 4,831,390 to Deshpande et al. This approach has eliminated the catastrophic printing failure mode. However, to lower the thermal resistance to the heat sink sufficiently that there is no appreciable device temperature rise in the time scale of a carriage translation in one direction across the paper, it may be necessary to take packaging approaches which would increase the cost or otherwise constrain the printer design in an undesirable way. The temperature rise must be maintained such that negligible image degradation occurs because of thermally induced spot size nonuniformities.

U.S. Pat. No. 4,712,930 to Maruno et al discloses a gradation thermal printhead and a gradation heat transfer printing apparatus which employs an energy controlling means for varying the voltage or pulse width of the signal pulse applied to a thermal printhead. The printing apparatus further has a power supply for the gradation thermal printhead and an energy controlling means for controlling the width of the pulse of the voltage applied to the thermal printhead in accordance with a recording signal.

U.S. Pat. No. 4,536,774 to Inui et al discloses a thermal head drive circuit which improves printing quality by using data from previously printed lines to compute a corrected pulse energy for the line being printed. A pulse energy operator uses data from a heat accumulation state operator, a memory which has data on the pulse energy used in the previously printed lines, and from either a pulse interval detector or a temperature detector.

U.S. Pat. No. 4,712,172 to Kiyohara et al discloses the use of the heating elements to preheat the printhead in the vicinity of the nozzles by subthreshold energy pulses insufficient to expel ink droplets to lower the viscosity of any plug of ink at the nozzles from which water has evaporated. Typically this preheating with subthreshold pulses is done when the ink jet printer is turned on or after it has sat idle for a period of time.

U.S. Pat. No. 4,791,435 to Smith et al discloses a thermal ink jet printhead having temperature sensors to provide the input needed to estimate the printhead temperature, so that the printhead may be kept at the desired predetermined time by slowing down the printing, if it is too hot to cool it off, or adds warming pulses too short to expel droplets, if it is too cold. All decisions and actions are made preceding a printing operation.

U.S. Pat. No. 4,910,528 to Firl et al discloses the use of a temperature sensor to measure the printhead temperature and a microcomputer to determine the pattern of droplets to be printed, so that prior to the commencement of printing, the number of droplets required to print the printed swath is known and used to predict the temperature at the end of swath. If the predicted printhead temperature exceeds a maximum value, the start of printing can be delayed or the printing mode can be modified. If the predicted printhead temperature is below a minimum value, the heating elements are pulsed with non-droplet ejecting current pulses or the sensor can be used as a supplementary heater to warmup the printhead before the start of printing. In conjunction with the current temperature of the printhead as sensed by a sensor thereon, the future printing demand is utilized to predict the printhead temperature at the end of the printing of a swath of information and the printing modified to ensure that the temperature limits are not exceeded.

U.S. Pat. No. 4,719,472 to Arakawa discloses the use of a separate heater and temperature sensor to heat and monitor the temperature of the ink in the reservoir to adjust the viscosity of the ink.

U.S. Pat. No. 4,490,728 to Vaught et al discloses the use of a two part electrical pulse to the heating elements of a thermal ink jet printer. The pulses comprise a precursor pulse insufficient to vaporize the ink following by a nucleation pulse to expel an ink droplet.

SUMMARY OF THE INVENTION

It is the object of the present invention to provide an improved thermal ink jet printhead which maintains itself at a substantially constant operating temperature while printing.

It is another object of the invention to maintain the operating temperature of the printhead constant during a printing mode by supplying supplemental heat thereto by applying non-vapor producing energy pulses to at least some of the heating elements that are not ejecting ink droplets.

In the present invention, a thermal ink jet printhead of the type having an ink supply manifold and a plurality of parallel ink channels with each having a nozzle and a heating element is improved by means for maintaining the printhead at a substantially constant operating temperature. In the printing mode, the printhead ejects ink droplets on demand by the selective energization of the heating elements with energy pulses having sufficient magnitude to vaporize instantaneously the ink in contact with the energized heating element, so that temporary vapor bubbles are formed which eject the ink droplet. The improvement comprises counting the pulses which expel droplets to determine the heat energy applied to the printhead and energization of predetermined heating elements with a sufficient quantity of energy pulses insufficient in magnitude to vaporize the ink at times when the heating elements are not being energized for the ejection of ink droplets to provide supplemental heat, as necessary, to maintain the printhead at a substantially constant operating temperature without the need of continually sensing the printhead temperature. Alternatively, the supplemental heat may be supplied by energizing one or more additional heaters on the printhead which are provided solely to supply heat and which are not used to vaporize ink to bring about droplet ejection.

In another embodiment, all of the heating elements are pulsed with subthreshold electrical pulses, which are insufficient in magnitude to vaporize ink during the standby mode. During the printing mode, those heating elements not being used to eject droplets are pulsed with subthreshold pulses.

A more complete understanding of the present invention can be obtained by considering the following detailed description in conjunction with the accompanying drawings, wherein like parts have the same index numerals.

DESCRIPTION OF THE PREFERRED EMBODIMENT

Figure 1:
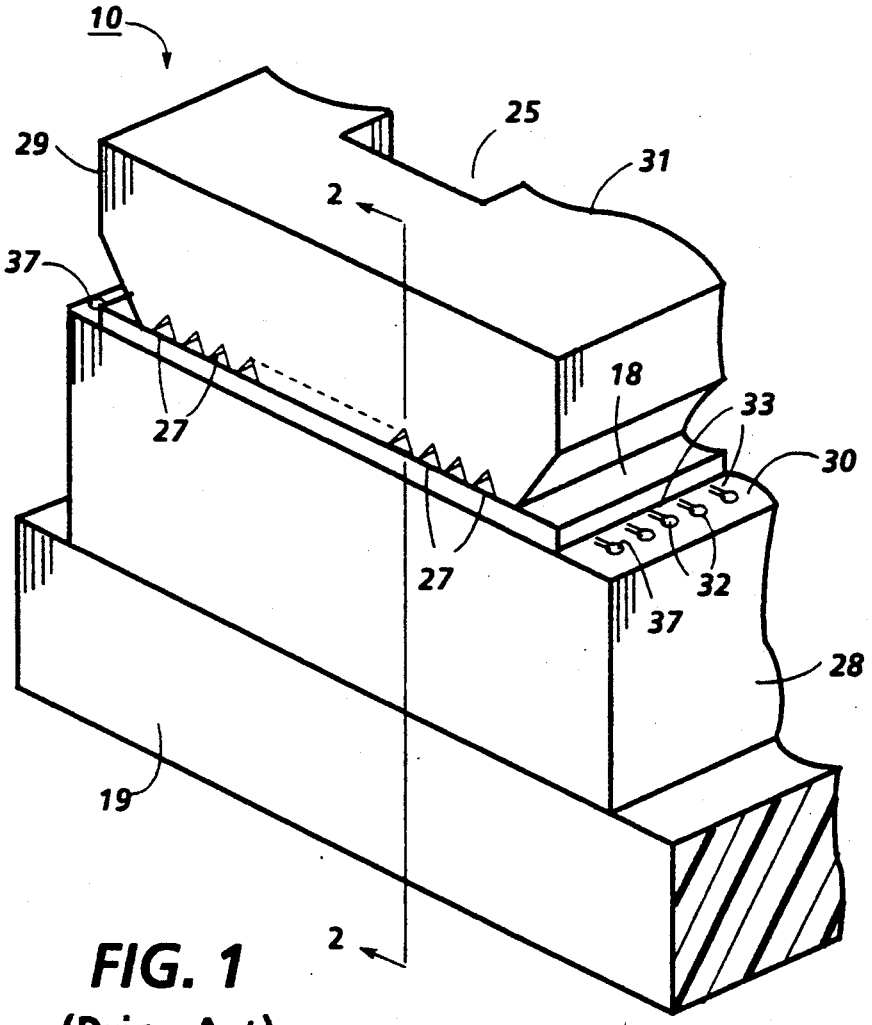
FIG. 1 (Prior Art)
FIG. 1 is a schematic, partial isometric view of a typical printhead containing the present invention.
Figure 2:
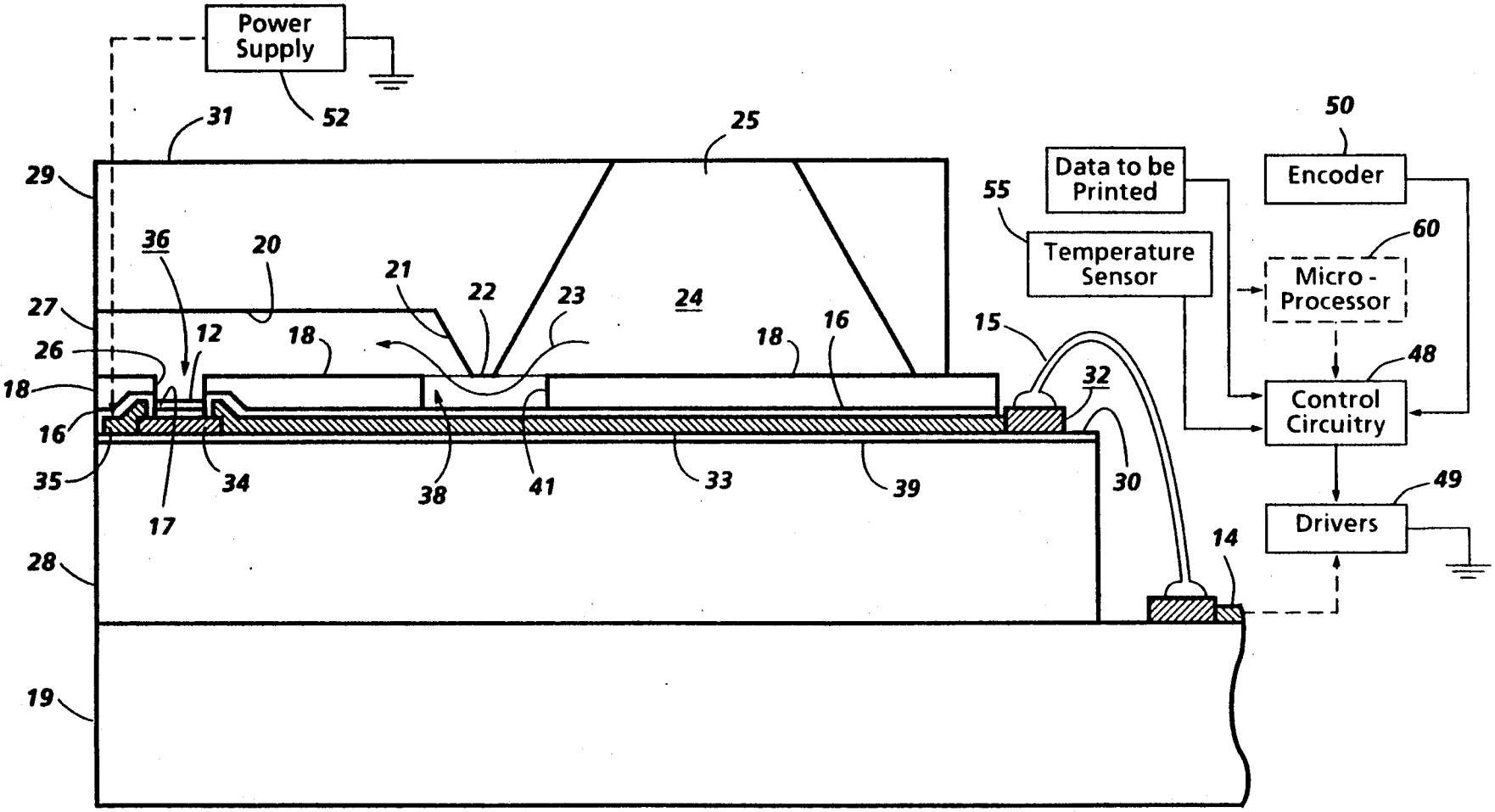
FIG. 2 is a cross sectional view of the printhead of FIG. 1 as viewed along view line 2—2 thereof with control circuitry of the present invention.

An enlarged, schematic isometric view of the front face 29 of a typical thermal ink jet printhead 10, showing an array of droplet emitting nozzles 27, is depicted in FIG. 1. Referring also to FIG. 2, discussed later, the lower electrically insulating substrate or heating element plate 28 has the multi-layered, thermal transducers 36, including the heating elements 34, and addressing electrodes 33 patterned on surface 30 thereof, while the upper substrate or channel plate 31 has parallel grooves 20 which extend in one direction and penetrate through the upper substrate front face edge 29. The other end of grooves terminate at slanted wall 21. The internal recess 24, which is used as the ink supply manifold for the capillary filled ink channels 20, has an open bottom 25 for use an an ink fill hole. The surface of the channel plate with the grooves are aligned and bonded to the heater plate 28, so that a respective one of the plurality of heating elements 34 is positioned in each channel, formed by the grooves and the lower substrate or heater plate. Ink enters the manifold formed by the recess 24 and the lower substrate 28 through the fill hole 25 and, by capillary action, fills the channels 20 by flowing through an elongated recess 38 formed in the thick film insulative layer 18. The ink at each nozzle forms a meniscus, the surface tension of which, together with the slight negative pressure of the ink supply, prevents the ink from weeping therefrom. The addressing electrodes 33 on the lower substrate or channel plate 28 terminate at terminals 32. The upper substrate or channel plate 31 is smaller than that of the lower substrate in order that the electrode terminals 32 are exposed and available for wire bonding 15 to the electrodes 14 on the daughter board 19, on which the printhead 10 is permanently mounted. Layer 18 is a thick film passivation layer, discussed later, sandwiched between upper and lower substrates. This layer is etched to expose the heating elements, thus placing them in a pit 26, and is etched to form the elongated recess 38 to enable ink flow between the manifold 24 and the ink channels 20. In addition, the thick film insulative layer is etched to expose the electrode terminals.

A cross sectional view of FIG. 1 is taken along view line 2—2 through one channel and shown as FIG. 2 to show how the ink flows from the manifold 24 and around the end 21 of the groove 20 as depicted by arrow 23. The ink droplets (not shown) are ejected by control circuitry 48, drivers 49, and power supply 52 in response to receipt of data to be printed. The encoder 50 monitors when the printhead is in the printing region and the optional microprocessor 60 counts the droplet ejecting electrical pulses applied to each of the heating elements 34. As is disclosed in U.S. Pat. No. 4,638,337 to Torpey et al, a plurality of sets of bubble generating heating elements 34 and their addressing electrodes 33 are patterned on the polished surface of a (100) silicon wafer. Prior to patterning the multiple sets of printhead electrodes 33, the resistive material 34 that serves as the heating elements, and the common return 35, the polished surface of the wafer is coated with an underglaze layer 39 such as silicon dioxide, having a thickness of about 2 micrometers. The resistive material may be a doped polycrystalline silicon which may be deposited by chemical vapor deposition (CVD) or any other well known resistive material such as zirconium boride ($ZrB_2$). The common return and the addressing electrodes are typically aluminum leads deposited on the underglaze and over the edges of the heating elements. The common return ends or terminals 37 and addressing electrode terminals 32 are positioned at predetermined locations to allow clearance for wire bonding to the electrodes 14 of the daughter board 19, after the channel plate 31 is attached to make a printhead. The common return 35 and the addressing electrodes 33 are deposited to a thickness of 0.5 to 3 micrometers, with the preferred thickness being 1.5 micrometers.

In the preferred embodiment, the lower substrate or heating element plate 28 is silicon with an underglaze layer 39 of thermal oxide or other suitable insulative layer such as silicon dioxide. Polysilicon heating elements 34 are formed and an insulative overglaze layer (not shown) is deposited over the underglaze layer and heating elements thereon. This overglaze layer may be either silicon dioxide, thermal oxide, or reflowed polysilicon glass (PSG). The thermal oxide layer is typically grown to a thickness of 0.5 to 1.0 micrometer to protect and insulate the heating elements from the conductive ink. Reflowed PSG is usually about 2 micrometers thick. The overglaze layer is masked and etched to produce vias therein near the edges of the heating elements for subsequent electrical interface with the aluminum (Al) addressing electrode 33 and Al common return electrode 35. In addition, the overglaze layer in the bubble generating region of the heating element 34 is concurrently removed. If other resistive material such as hafnium boride or zirconium boride is used for the heating elements, then other suitable well known insulative materials may be used.

The next process step in fabricating the thermal transducer is to deposit a pyrolytic silicon nitride layer 17 directly o the exposed polysilicon heating elements, followed by the deposition of about one micrometer thick tantalum layer 12 for cavitational stress protection of the pyrolytic silicon nitride layer 17.

The pyrolytic silicon nitride serves two very useful functions. First, it has very good thermal conductivity, so that it produces a thermally efficient resistor structure when deposited directly in contact with the resistor. Secondly, it is one of few materials that is resistant to Ta etches.

The multi-layered, thermal transducer structure is completed with either 4 wt % CVD PSG or preferably, plasma nitride lead passivation. Either of these materials can be selectively etched off the Al bonding pads and resistor area.

For electrode passivation, a two micrometer thick phosphorous doped CVD silicon dioxide film 16 is deposited over the entire heating element plate or wafer surface, including the plurality of sets of heating elements and addressing electrodes. The passivation film 16 provides an ion barrier which will protect the exposed electrodes from the ink. Other ion barriers may be used, such as, for example, polyimide, plasma nitride, as well as the above-mentioned phosphorous doped silicon dioxide, or any combinations thereof. An effective ion barrier layer is achieved when its thickness is between 1000 angstroms and 10 micrometers, with the preferred thickness being 1 micrometers. The passivation film or layer 16 is etched off of the terminal ends of the common return and addressing electrodes for wire bonding later with the daughter board electrodes. This etching of the silicon dioxide film may be by either the wet or dry etching method. Alternatively, the electrode passivation may be accomplished by plasma deposited silicon nitride ($Si_3N_4$).

Next, a thick film type insulative layer 18 such as, for example, Riston ®, Vacrel ®, Probimer 52 ®, or polyimide, is formed on the passivation layer 16 having a thickness of between 10 and 100 micrometers and preferably in the range of 25 to 50 micrometers. The insulative layer 18 is photolithographically processed to enable etching and removal of those portions of the layer 18 over each heating element (forming recesses 26), the elongated recess 38 for providing ink passage from the manifold 24 to the ink channels 20, and over each electrode terminal 32, 37. The elongated recess 38 is formed by the removal of this portion of the thick film layer 18.

In thick film layer 18, the pit 26 is formed having walls 42 that exposes each bubble generating area of the multi-layered thermal transducer 36 and walls 41 defining an elongated recess 38 to open the ink channels to the manifold. The recess walls 42 inhibit lateral movement of each bubble generated by the pulsed heating element which lie at the bottom of recesses 26, and thus promote bubble growth in a direction normal thereto. Therefore, as disclosed in U.S. Pat. No. 4,638,337, the blowout phenomena of releasing a burst of vaporized ink which causes an ingestion of air is avoided.

The passivated addressing electrodes are exposed to ink along the majority of their length and any pinhole in the normal electrode passivation layer 16 exposes the electrode 33 to electrolysis which would eventually lead to operational failure of the heating element addressed thereby. Accordingly, an added protection of the addressing electrode is obtained by the thick film layer 18, since the electrodes are passivated by two overlapping layers, passivation layer 16 and a thick film layer 18.

As disclosed in U.S. Pat. Nos. Re. 32,572 and 4,638,337 and incorporated herein by reference, the channel plate is formed from a (100) silicon wafer to produce a plurality of upper substrates 31 for the printhead. The heating element plate 28 is also obtained from a wafer or wafer sized structure (not shown) containing a plurality thereof. Relatively large rectangular through recesses and a plurality of sets of equally, spaced parallel V-groove recesses are etched in one surface of the wafer (not shown). These recesses will eventually become the ink manifolds 24 and ink channels 20 of the printheads. The channel plate and heating element plate containing wafers are aligned and bonded together, then diced into a plurality of individual printheads. One of the dicing cuts produces end face 29, opens one end of the elongated V-groove recesses 20 producing nozzles 27. The other ends of the V-groove recesses 20 remain closed by end 21. However, the alignment and bonding of the above-mentioned wafers places the ends 21 of each set of channels 20 directly over elongated recess 38 in the thick film insulative layer 18 as shown in FIG. 2, enabling the flow of ink into the channels from the manifold 24 as depicted by arrow 23.

The temperature of the improved printhead is held substantially constant, even though it is not ejecting droplets at the extreme ends of the carriage translation. As disclosed in U.S. Pat. No. 4,571,599 to Rezanka and shown in FIG. 3, a typical multicolor thermal ink jet printer 11 is shown containing several disposable ink supply cartridges 22, each with an integrally attached printhead 10 of the present invention. The cartridge and printhead combination are removably mounted on a translatable carriage 40. Curing the printing mode, the carriage reciprocates back and forth on, for example, guide rails 43 parallel to the recording medium 44 as depicted by arrow 45. The end-to-end travel distance of the carriage and printheads is shown as distance B. The recording medium, such as, for example, paper, is held stationary while the carriage is moving in one direction and, prior to the carriage moving in a reverse direction, the paper is stepped in the direction of arrow 46 a distance equal to the height of the swath of data printed thereon by the printheads 10 during traversal in one direction across the paper. The width of the recording medium is the printing zone or region during the carriage traversal and is indicated as distance A. To enable printing by all of the plurality of printheads and to accommodate printhead priming and maintenance stations (not shown), the overall travel distance B is larger than the printing region A. Thus, an encoder 50 (see FIGS. 2 and 5) must be used to monitor when the printheads are within the printing region. The droplets are ejected on demand from the nozzles 27 in front face 29 of the printheads along the trajectories 47 to the paper. The front face of the printhead is spaced from the paper a distance of between 0.01 and 0.1 inch, with the preferred distance being about 0.02 inches. The stepping tolerance for the paper and the linear deviation of the printheads are held within acceptable limits to permit contiguous swaths of information to be printed without gaps or overlaps.

Each cartridge 40 contains a different colored ink, one black and one to three additional cartridges of different selected colors. The combined cartridge and printhead is removed and discarded after the ink supply in the cartridge has been depleted. In this environment, some of the nozzles do not eject droplets during one complete carriage traversal and, generally, none of the nozzles eject droplets as the printheads move beyond the edge of the paper. While at this end of a carriage traversal, there is a small dwell time while the paper is being stepped one swath in height in the direction of arrow 46. Thus, as discussed above, the printhead of the prior art printers cool down. However, the printheads of the present invention are kept at a constant operating temperature by the application of electrical or energy pulses to the heating element not ejecting droplets having insufficient magnitude to vaporize the ink. This supplemental heat keeps the operating temperature of the printhead constant. The number of unused heating elements, the pulse widths, and/or the power of the supplemental pulses control the printhead temperature while it is in the printing mode.

In the preferred embodiment of FIG. 5A, discussed later, a zero data detector 54 enables all heating elements of the printhead to be pulsed with non-droplet ejecting or subthreshold pulses to maintain the operating temperature of the printhead substantially constant. Periodically, the ambient printer temperature is checked by a temperature sensor 55 located within the printer (not shown) and in the vicinity of the printhead 10 for a reference temperature which the logic controller uses to control the compensating energy applied by subthreshold pulses. Optionally, the temperature of the printhead could be used instead of the ambient printer temperature. This reference temperature is checked at startup, when entering the printing mode, and at the conclusion of printing a predetermined number of full pages, rather than sensing the printhead temperature continually or frequently such as during or after each swath of printed information as required by the prior art. Thus, this invention does not need to continually check the printhead temperature or even check for a reference temperature more frequently than after printing more than one page. A pulse count look up table 51 in response to the pulse counter 61, which counts the droplet ejecting pulses required by the data to be printed, determines the umber and width of the non-droplet ejecting (subthreshold) pulses in conjunction with the subthreshold pulse width controller 56 and enables the logic controller to apply the required subthreshold pulses having the appropriate pulse width to the heating elements not ejecting droplets.

Optionally, a microprocessor 60 counts the droplet ejecting pulses per heating element per unit of time, so that if the number of heating elements used and/or the rate of droplets expelled are not within predetermined values, supplemental heat is applied to the printhead by subthreshold pulsing of the least used heating elements. Subthreshold pulses are not capable of vaporizing the ink, so that droplets are not ejected. A consequence of using supplemental heat to keep the temperature of the printhead constant during printing is that the average device temperature will be higher than it would be otherwise. However, this is an advantage, if the temperature is kept below a predetermined maximum temperature, whereat the printhead begins to fail. This maximum temperature is about 70° C. when the inks used comprise ethylene glycol and a water base, but varies with different ink formulations and ink channel geometries. Below 70° C., the drop velocity becomes more uniform as the temperature is increased. At 20° C., some ink channels of the printhead having water based ink formulations have been observed to have marginally acceptable droplet velocities. The droplet velocity increases to a highly satisfactory range with a moderate increase in printhead temperature. The ideal operating point depends on ink and device parameters, but in the present case would appear to be roughly 30° C. to 50° C. An additional advantage of operating at elevated temperature is that the ink viscosity decreases, so that refill times of the channels may be decreased, enabling higher printing frequencies. The printhead 10 has a heat sink 71 with a predetermined heat dissipating capacity, so that the heat added to the printhead by the droplet ejecting pulses and the subthreshold pulses will be dissipated at a known rate and taken into account by the pulse count look up table 51 and/or the optional microprocessor 60.

Figure 4:
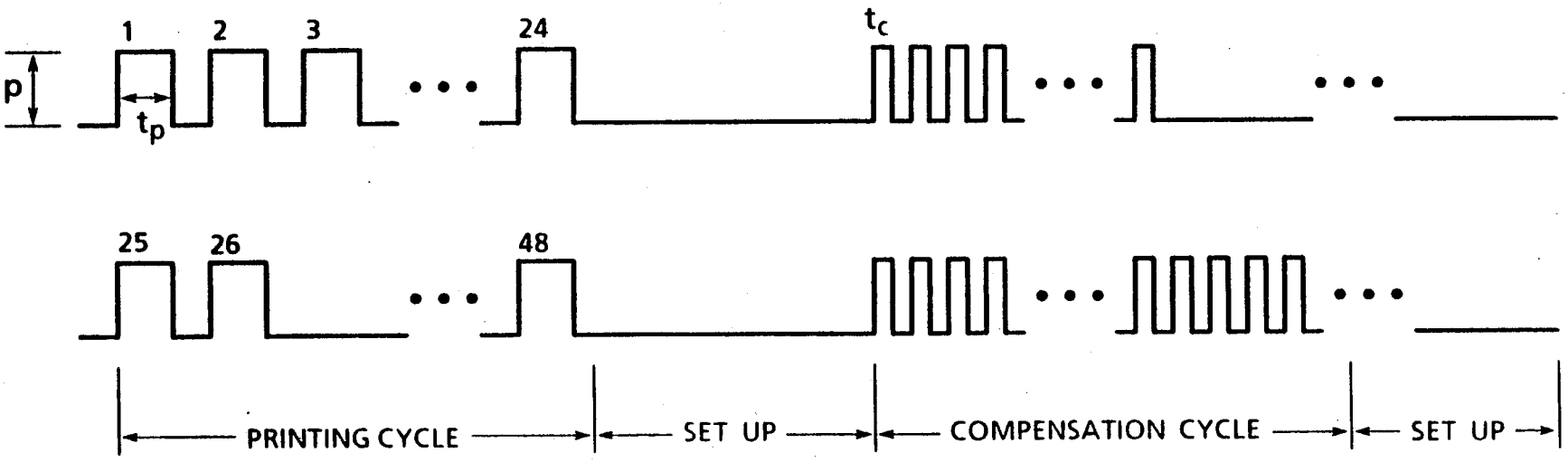
FIG. 4 is a sample plot of an example energy compensating pulse technique to add heat as required to the printheads.

In FIG. 4, one embodiment of this invention is shown in which, for example, a 48 jet or channel printhead is used, printing up to two channels at a time. In this example of an energy compensating pulse scheme, the 48 channels are being pulsed 2 at a time and channels 1, 2, 3, 24, 25, 26 and 48 are assumed to have printed. The shorter pulses during the compensation cycle are provided so that the total energy dissipated in the time interval associated with a group of 48 pixels is constant. Since the carriage is moving continuously, it is necessary to finish printing all 48 jets in a fraction of the time it takes to get from one pixel to the next, or the dot or pixel pattern will be too jagged. AT 2 kHz operation, we have 500 μsec to get from one pixel position to the next, while at 3 kHz, we would have 333 μsec. By comparison, the printing cycle is composed of 24 intervals of 5 μsec (120 μsec total), during which up to two channels will be fired or energized at a time using about 3 μsec duration pulses. The energy dissipated during the printing cycle in one set of up to 48 pixels is $E_p = n\ P\ t_p$, where n is the number of channels fired (0 to 48), P is the power per print pulse, and $t_p$ is the pulse width (3μsec in our example). The maximum energy dissipated is $E_{max} = NP\ t_p$, where N=48 in our example. For strictly constant energy input, m short pulses would be added (none of which is sufficient for bubble nucleation) during what is normally a "rest period", so that $E_p + E_c = n\ P\ t_p + m\ P\ t_c = E_{max} = N\ P\ t_p$, where $E_c$ is the compensating energy and $t_c$ is the pulse width or duration of the compensating pulse. For example, if $t_c = t_p/4$ (0.75 μsec), then $n + m/4 = 48$, and during period s of time when printing is not occurring (n=0), there would be 192 of the short pulses required. For 2 kHz operation the energy compensating cycle would be 350 μsec (allowing 120 μsec printing cycle and 30 μsec setup times). By pulsing up to 2 heaters at a time during the energy compensating cycle, as would be done during the printing cycle, there will be 96 pulse intervals, so that the short pulses would be on for 0.75 μsec and off for 2.9 ρsec. Other cases of interest are shown in Table 1, assuming 120 μsec printing cycle and 30 μsec setup times. Selection criteria are that bubbles not be nucleated during $t_c$, but that the driver transistors be fast enough.

TABLE 1

| | Energy Compensating Pulse Widths (μsec) | | |
|---|---|---|---|
| $t_p/t_c$ | t on | 2 kHz t off | 3 kHz t off |
| 4 | .75 | 2.9 | 1.2 |
| 3 | 1.0 | 3.9 | 1.5 |
| 2 | 1.5 | 5.8 | 2.3 |

A variety of method or embodiments may be devised for implementing the logic for the energy compensation pulses. One method would be to count the pulses during the printing cycle and decrement a counter for the compensation cycle accordingly. Referring to FIG. 5A, this method does not keep track of which heating elements were fired, unless the optional microprocessor 60 is used, and would simply cycle through the heating elements not being used to eject droplets until enough compensating pulses were fired. The pulse counter 61, zero data detector 54 and logic controller 58 of the control circuitry 48 receive data to be printed in the form of digitized data signals. The encoder 50 provides signals indicative of the location of the printhead 10, relative to the printing region A of FIG. 3, to the logic controller 58 and subthreshold pulse width controller 56. The pulse counter 61 determines how many jet or heating elements are being fired during a particular time interval. Jets fired have a pulse width given by the ejection pulse controller 62. In the event that the zero data detector 54 indicates that no jets are to be fired (i.e., no droplets are to be ejected as when a new page of printing has not begun, or the printhead has reached the end of a line, or during white space within a line), it indicates to the logic controller 58 that subthreshold pulse firing may occur. The pulse count look up table 51 compares the number of droplet ejection pulses which have recently been first or are about to be fired, and indicates to the subthreshold pulse width controller 56 how many and how wide the subthreshold pulses should be to bring the printhead 10 to the desired operating point.

In the preferred embodiment, the power supply 52 provides a constant voltage $V_o$ to the common return electrode 35. The heating elements 34 are pulsed with this voltage through drivers 49 which are connected to the printhead addressing electrodes 33 and to ground. Thus, the electrical pulses applied to the heating elements or resistors 34 have a constant amplitude and the width is varied to eject a droplet or provide only supplemental heat with pulse widths insufficient to vaporize ink. Clock 53 provides the timing for the logic controller 58. The control circuitry 48 may optionally contain a look up table 57 (shown in dashed line) which receives input signals representative of the ambient temperature from temperature sensor 55 located within the printer (not shown) in the vicinity of the printhead or optionally thereon. Based upon the temperature sensor, the subthreshold pulse width controller signals the logic controller for supplemental heat generating electrical pulses insufficient to eject droplets.

An optional dedicated heater 59 on the printer, but not shown in FIG. 2, could also be used to provide the required supplemental heat to the printhead instead of pulsing the heating elements, as is well known in the art.

An optional microprocessor 60 keeps track of which heating elements have not been fired very often and employs those heating elements which have not been used often to do the threshold pulsing, in order to average out the overall number of pulses for each heating element for lifetime purposes. This is accomplished by counting the number of droplet-ejecting pulses each heating element received during a predetermined time period, such as, for example, during the printing of a swath of information. This count per heating element could be stored and averaged or simply erased after each printed swath or printed page.

Figure 5A:
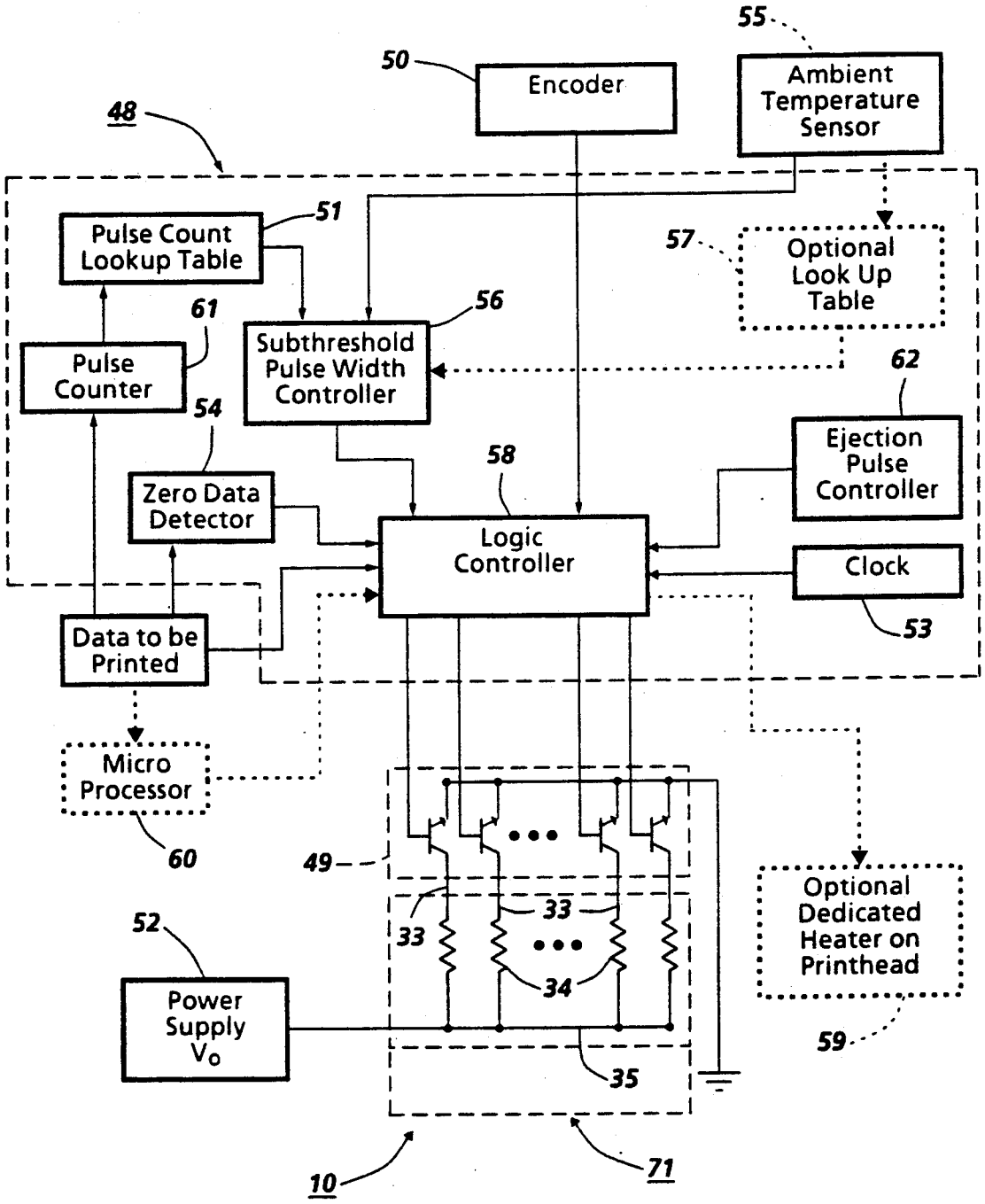
FIG. 5A is a schematic diagram of the control circuitry of FIG. 2.
Figure 5B:
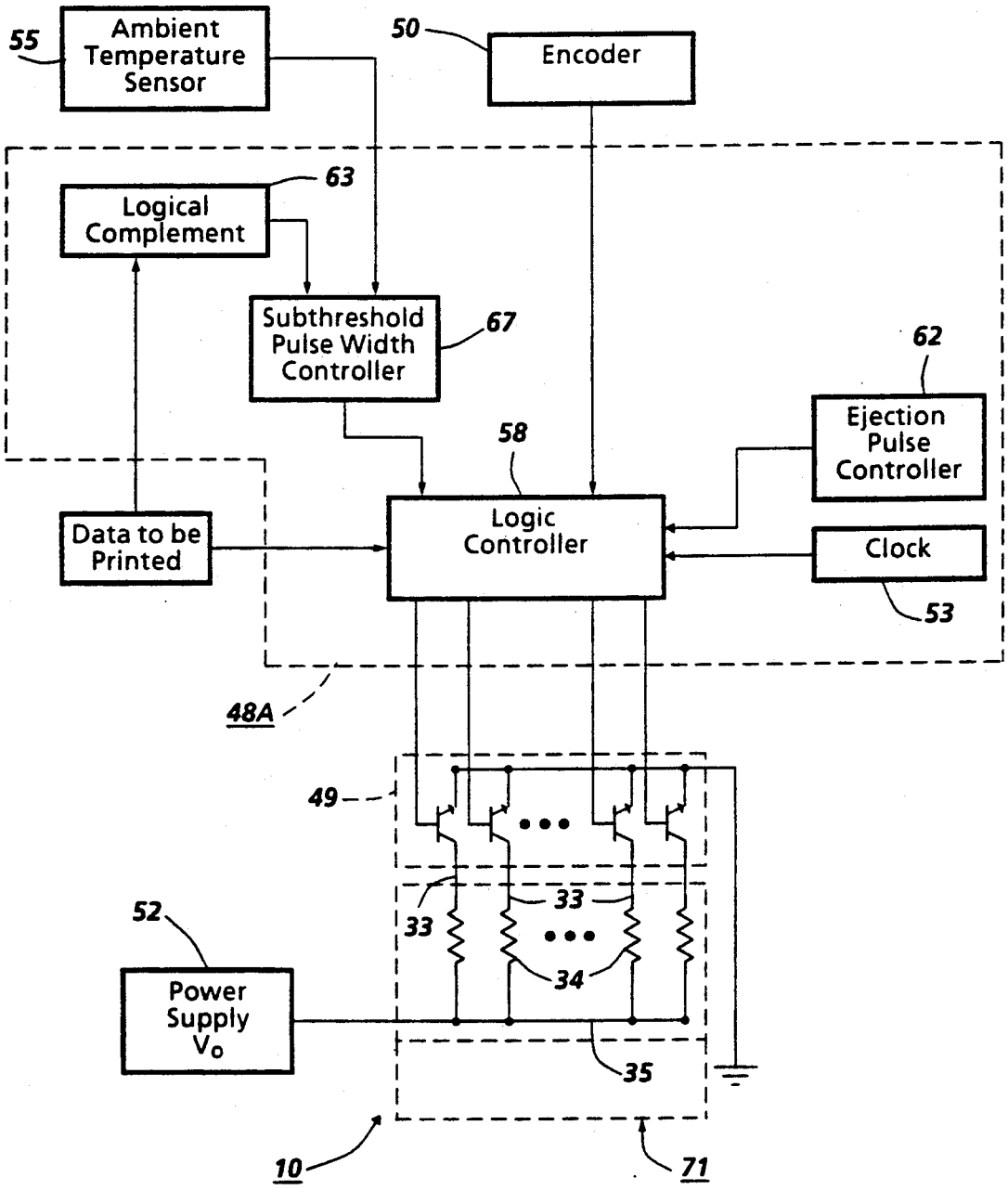
FIG. 5B is a schematic diagram of an alternate embodiment of the control circuitry of FIG. 5A.

Alternately, as shown in FIG. 5B, a device 63 for determining the logical complement of the printing data is given to the subthreshold pulse width controller 67 so that those heating elements which are not fired to eject droplets are automatically pulsed with subthreshold pulses. This ensures that each heating element experiences the same number of pulses for lifetime purposes, although some experience a greater number of droplet ejection pulses.

Figure 6:
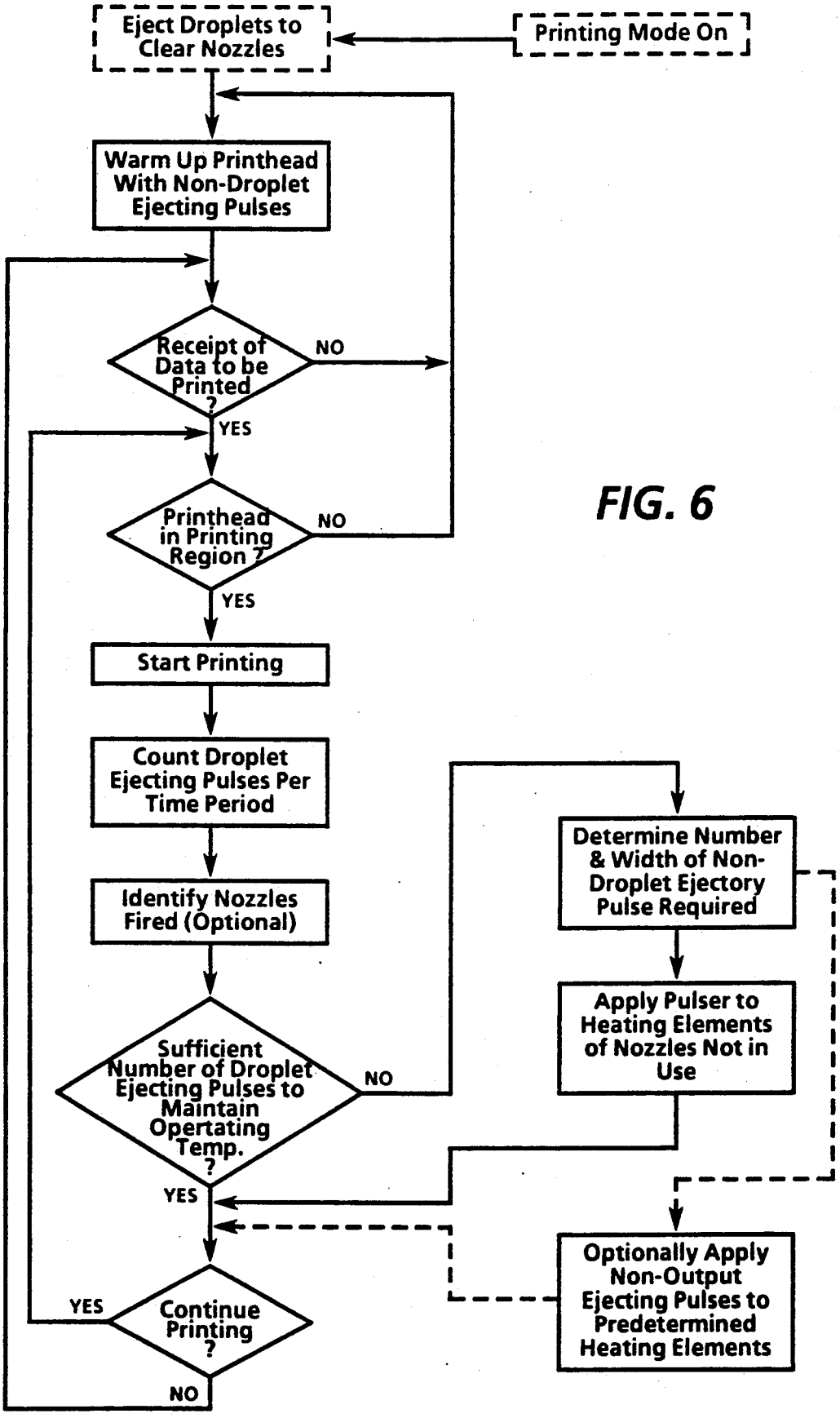
FIG. 6 is a flow chart of the decisions made by the pulse width controller and logic controller of the control circuitry of FIG. 5A.

The decisions made by the pulse width controller 56 in the control circuitry 48 of FIG. 5A is shown in the flow chart of FIG. 6. When the printing mode is activated, the ink channels are primed and the heating elements are all pulsed with electrical current pulses having sufficient magnitude or average power to vaporize the ink in contact therewith and eject nozzle clearing droplets in an ink collection recess or absorbent material forming part of a maintenance station (not shown). After a predetermined number of droplets are ejected from each nozzle, the printhead warmup is continued with application of subthreshold electrical pulses to the heating elements. By subthreshold, it is meant those pulses having insufficient energy or average power to vaporize ink and expel ink droplets.

Figure 3:
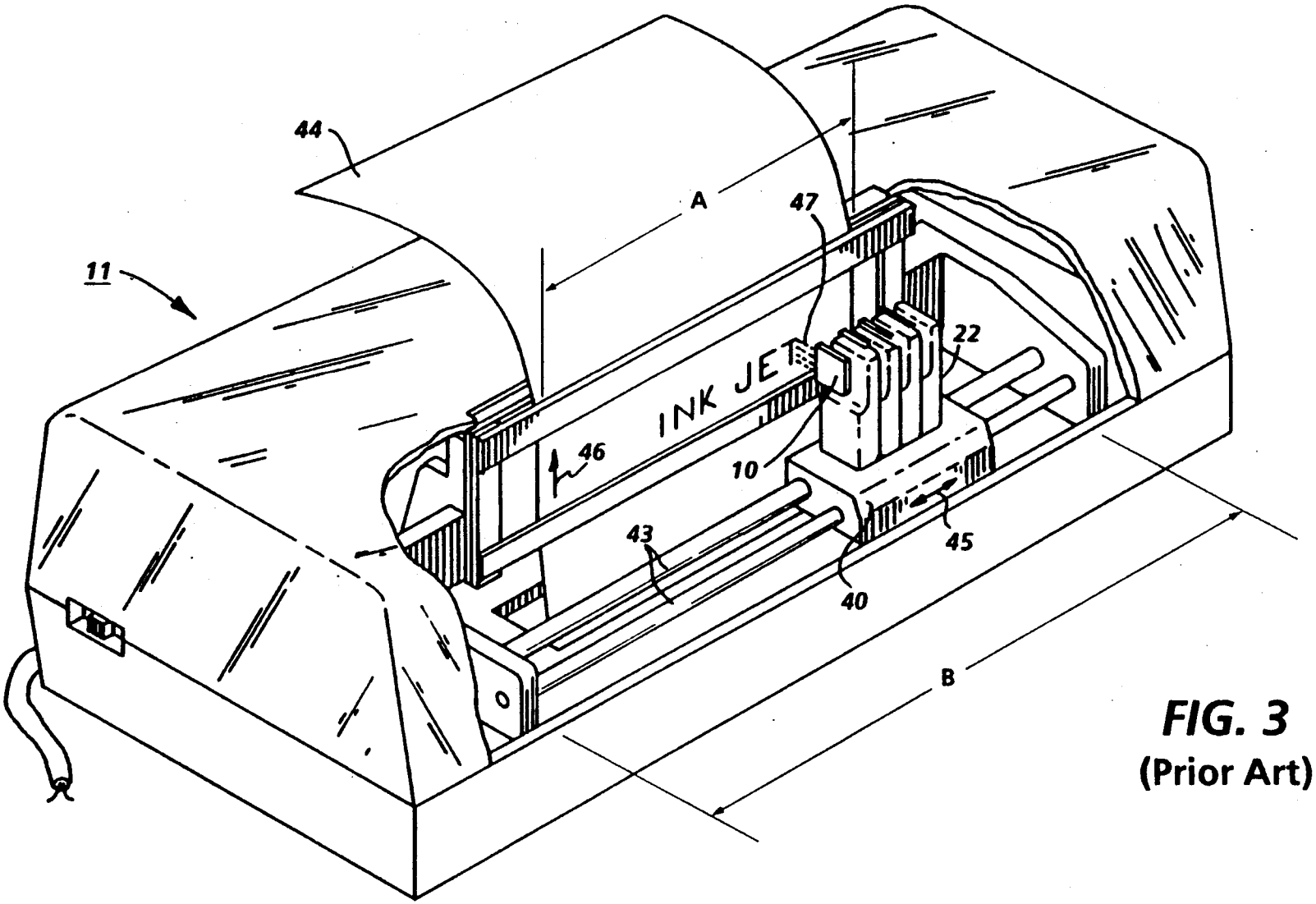
FIG. 3 (Prior Art)
FIG. 3 is a schematic isometric view of a typical carriage type multi-color thermal ink jet printer having the printheads of FIG. 1 integrally attached to disposable ink cartridges.

Upon receipt of digitized data to be printed, the location of the printhead is checked to see if it is within the printing region A as shown in FIG. 3. If not, the printhead is pulsed with subthreshold pulses to provide supplemental heating while it is moved into proper position for printing. Once the printhead is in the printing region, droplets are ejected and propelled to a recording medium 44. The pulse counter 61 counts the number of pulses which eject droplets and the logic controller 58 determines the pulses per clock time unit, that is the printing rate or density, and compares this rate or density with a minimum value required to maintain the operating temperature of the printhead within the appropriate temperature range.

Optionally, the microprocessor 60 identifies which nozzles were fired; i.e. used to expel droplets. If the printing density is sufficient to maintain the printhead operating temperature sufficiently constant, printing is continued without supplemental heating. If not, the number and width of subthreshold pulses required are determined by the logic controller and those heating elements not being used to eject droplets are pulsed with the subthreshold pulse. If desired, the subthreshold pulses can be applied only to those heating elements which have not ejected a droplet during the time period for which the droplet rate or density was measured. For example, at intermediate points along a swath of printed droplets or at the end of a printed swath or both.

Thus, the operating temperature of the printhead of the present invention is maintained substantially constant within the appropriate temperature without the need for continually measuring the printhead temperature and modifying the printing speed to cool it down or add heat to boost the temperature until the printhead sensor reads the desired value.

Figure 7:
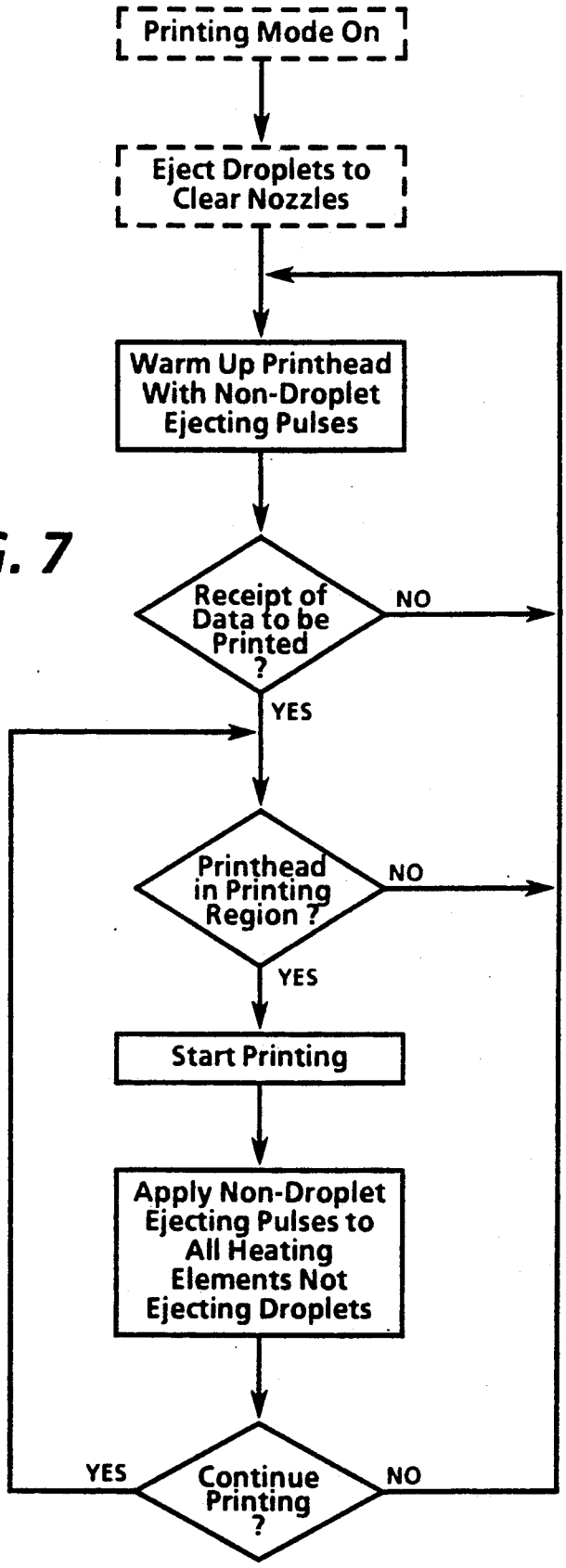
FIG. 7 is a flow chart of the decisions made by logic complement and logic controller of the control circuitry of FIG. 5B.

A temperature sensor 55 within the printer is used periodically during standby or initial start-up of printing, but constant reference to it is not required. The decisions made by the control circuitry 48A of FIG. 5B are shown in the flow chart of FIG. 7. AS in the flow chart of FIG. 6, the ink channels are primed and the heating elements pulsed to eject nozzle clearing droplets when the printing mode is activated. After a predetermined number of droplets are ejected from each nozzle, the printhead warmup is continued with the application of subthreshold pulses to the heating elements.

Upon receipt of data to be printed, the location of the printhead is checked to see if it is within the printing region by the encoder 50. If not, the printhead is pulsed with subthreshold pulses to provide supplemental heating while it is being moved into the proper position for printing. Once the printhead is in the printing region, droplets are ejected and propelled to the recording medium 44. The logical complement 63 identifies those heating elements not being used to eject droplets, and in response to the logical complement input, the subthreshold pulse width controller 67 and ejection pulse controller 62 via logic controller 58 apply respective pulses to each heating element. In this arrangement all of the heating elements are fired or pulsed with either droplet ejecting pulses or subthreshold pulses during the actual printing operation. Thus, when no data is to be printed, only subthreshold pulses are applied to the heating elements. The subthreshold pulse width is determined by the ambient temperature sensor 55 and the known heat transfer rate from the heat sink 71.

This invention does not restrict itself to the case of $E_p+E_c=E_{max}$. For one thing, $E_c$ should probably be somewhat less than $E_{max}$-$E_p$ because no heat is being carried off by ejected drops during the compensation cycle. In addition, it is not necessary to keep the printhead temperature exactly constant. It may be found that an upper limit of compensation less than $E_{max}$ is satisfactory. The advantage of using less energy compensation is that it would be easier to maintain a thermal equilibrium which did not approach the upper operating temperature for a longer period of time.

Energy compensation will be required whenever printing is occurring or about to occur. In particular, energy compensation should continue at its maximum rate during carriage pauses at the end of travel. It should also occur just preceding starting to print. Warmup time should not be objectionably long, but in a one page per minute printer 1–4 seconds should be satisfactory for a large part of the temperature rise occurs within 3 seconds. The heat sinking should be designed so that the device temperature is raised for the most part within a few seconds, and then rises much slower after that. Energy compensation could also be applied for the longer term heating effects, e.g., by decrementing a counter a certain number of pulses for each line printed. The other heat sink requirement is that the device temperature remain in the optimal range (e.g., 40° C. ±10° C.).

Energy compensation may also be controlled by modifying the pulse width, $t_c$, depending on the number of channels fired during the printing cycle. In one embodiment, short compensating pulses are fired only during the compensation cycle. In another embodiment, short pulses are fired during the printing cycle as well, with the pulse width widened for those channels where printing is desired. The minimum pulse width increment would be determined by the fastest clock in the system, which might typically be 10–20 MHz. Another way to control the energy compensation is to modify its pulse power, but this is more difficult to implement. It has been assumed here that the compensation energy is provided by the same heating elements responsible for printing, but this is not a requirement. One or more special heating elements (not shown) for supplying only supplemental heat may be formed anywhere on the heating element plate 28, preferably in a location where they do not contact the ink.

The advantages of this inventive compensating pulsing scheme are as follows:

1. It may be implemented without temperature sensors or extra heating elements being on the printhead.
2. It is capable of making thermally induced spot size variation and banding negligible.
3. Thermal packaging to obtain a lower thermal resistance path from device to heat sink becomes less critical.
4. Peak power required for bubble formation is reduced, since spot size increases with device temperature as well as print pulse condition.
5. Operation at elevated temperature will improve uniformity of drop velocity, thus improving the yield of good performing devices.
6. Operation at elevated temperature is expected to decrease ink viscosity within the device, and improve channel refill times.

An additional feature that might prove useful is a temperature sensor on the printhead that measures the absolute temperature. The energy compensation scheme could then be modified, for example, through the use of lookup tables to provide the desired device temperature independent of ambient temperature or length of time the printer has been operating.

Although the above description was cast in terms a carriage type ink jet printer, this invention is equally applicable to a page width or partial page printer. The subthreshold pulses would keep all of the subunits or modules making up the page width printhead at the same temperature, so that they would produce droplets having the same volume and the printed spot size would be uniform. By applying subthreshold temperature compensating pulses in relation to the density of printing by each module, they all could be maintained within the desired operating temperature without the need of individual temperature sensors on each printhead subunits, but only one within the pagewidth printhead structural bar.

Figure 8A:
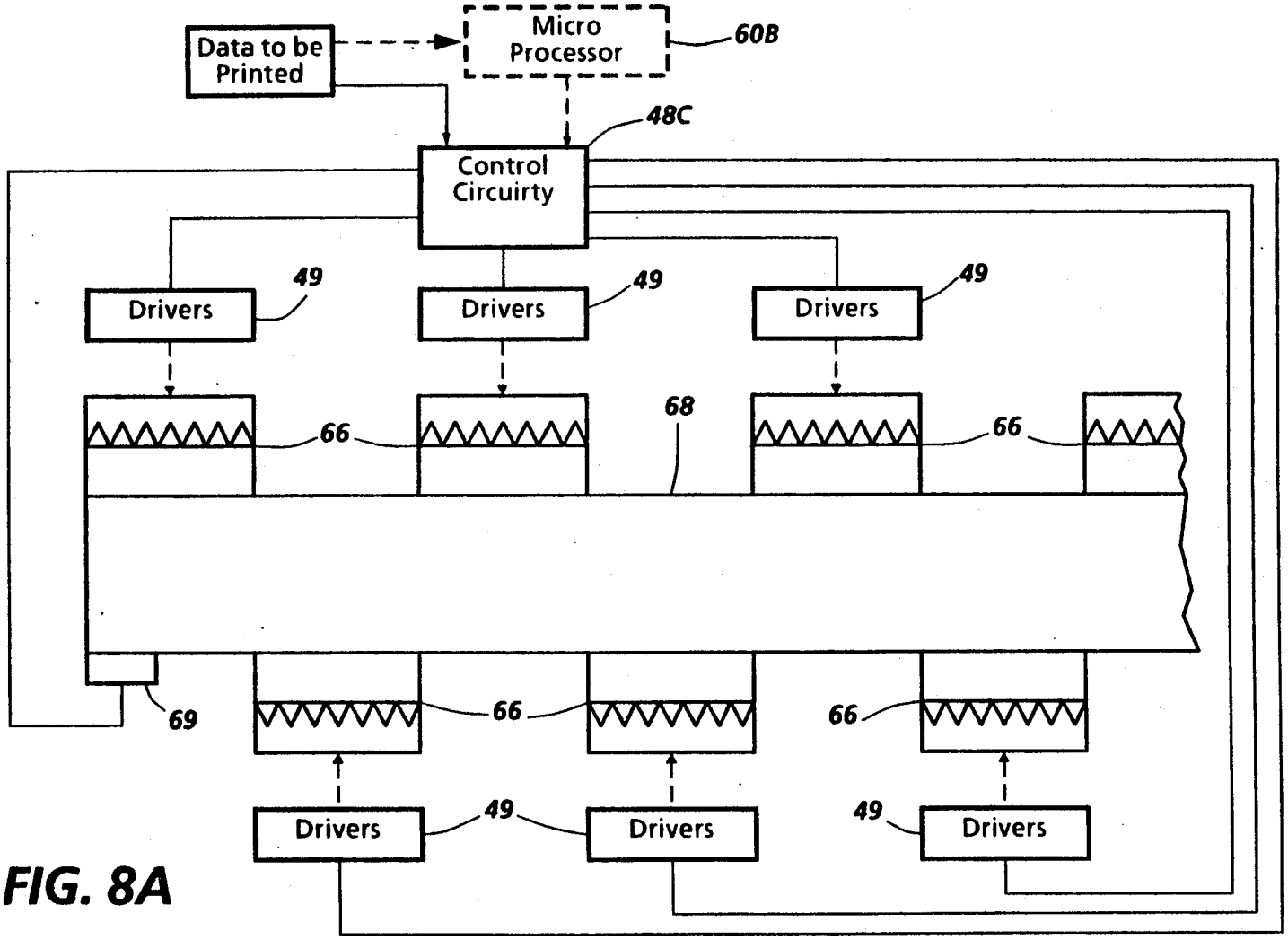
FIG. 8A is a partially shown, schematic front view of a pagewidth printhead having a plurality of fully functional subunits mounted on opposite sides of a structural bar.
Figure 8B:
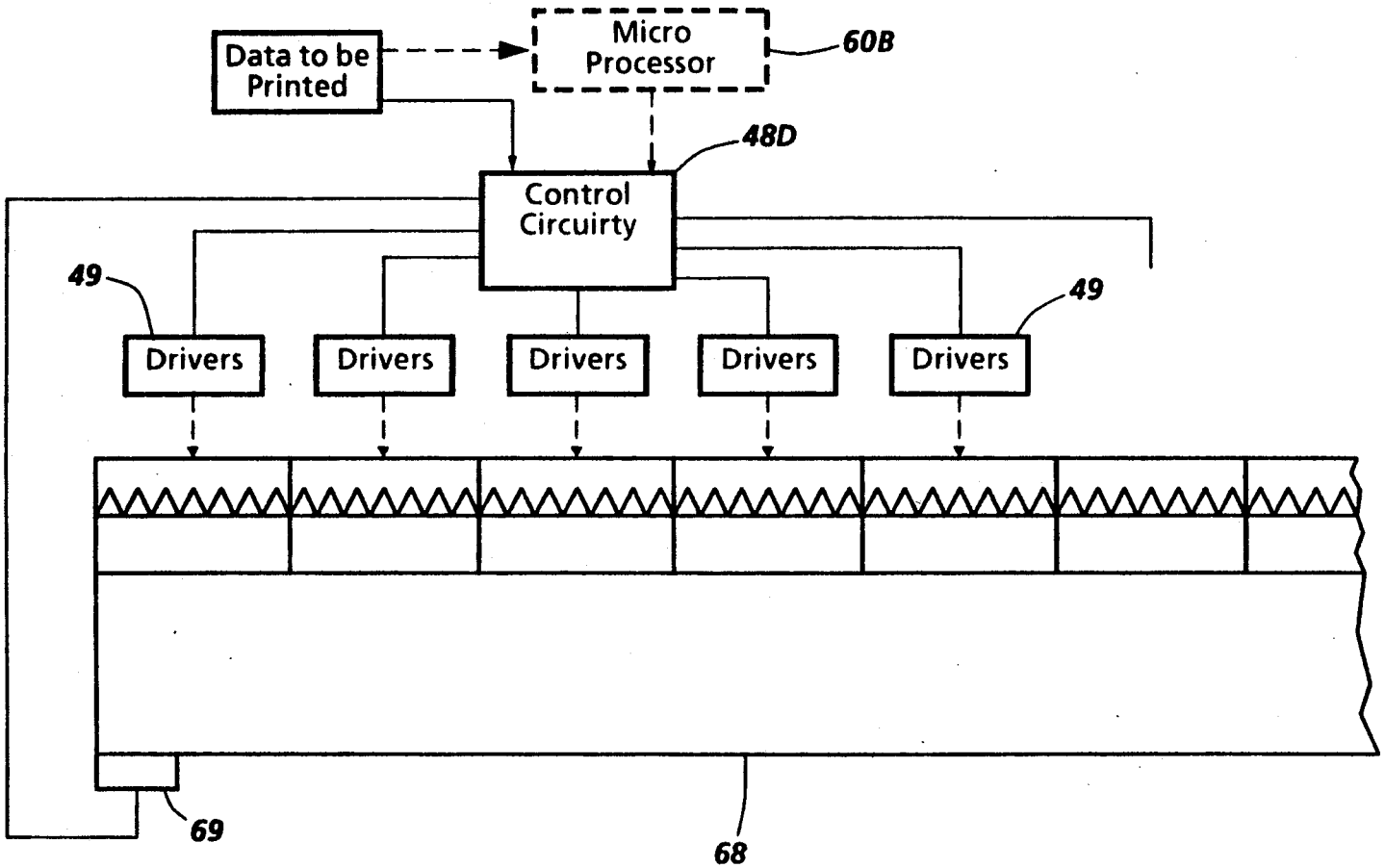
FIG. 8B is a partially shown, schematic front view of a pagewidth printhead having a plurality of fully functional subunits mounted on the same side of a structural bar.

In one embodiment, a printhead is composed of a plurality of fully functional, small individual printhead subunits. Each subunit could be used individually as a carriage type printhead capable of being scanned across a recording medium to print a swath of pixels or dots of ink. Referring to FIGS. 8A and 8B, a plurality of the printhead subunits 66 are mounted on a structural bar 68 which could either be translated across a recording medium, (not shown) to print partial pages (e.g., one large swath of information) or be fixed for page width printing where the recording medium is moved thereby at a constant velocity. In FIG. 8A, the subunits are alternately mounted on opposite sides of the bar with spaces between subunits on the same side of the bar. A single temperature sensor 69 mounted on the bar is used to establish a reference temperature for determining the number and/or width of the subthreshold pulses applied to the heating elements of each printhead subunit 66. The control circuitry 48C or 48D either uses the logic complement (not shown) of the data to be printed to apply subthreshold pulses (those pulses having a magnitude insufficient to vaporize ink) to all heating elements in each subunit not ejecting droplets or counts the droplet ejecting pulses and through a lookup table determines the number and pulse width of the subthreshold pulses of predetermined heating elements not ejecting droplets. A microprocessor 60B could be optionally used to count the number of droplets ejected by each heating element in each subunit and apply subthreshold pulses to the heating elements least used to eject droplets. The droplet ejecting or subthreshold pulses are applied by the control circuitry via the drivers 49. The temperature sensor provides a reference temperature of the structural bar 68 or ambient temperature which is only used at startup and then periodically, but infrequently, as a reference parameter. The primary control of the operating temperature is by monitoring the heat energy applied to the printhead subunits in the form of droplet ejecting or subthreshold pulses per unit of time after the reference or ambient temperature has been established. Thus the desired operating temperature of each subunit is maintained within the same desired operating temperature without the need of individual temperature sensors on each printhead subunit.

Many modifications and variations are apparent from the forgoing description of the invention, and all such modifications and variations are intended to be within the scope of the present invention.

We claim:

1. A method of maintaining the operating temperature of a thermal ink jet printhead substantially constant while it is in a printing mode and ejecting ink droplets from a plurality of nozzles therein, comprising the steps of:

counting a number of ink droplet ejecting electrical pulses applied to heating elements within the printhead that effect the ejection of ink droplets form the printhead nozzles during predetermined time periods;

comparing the counted number of said droplet ejecting pulses per predetermined time period with a minimum number required per predetermined time period to maintain the desired operating temperature constant and determining a number of droplet ejecting pulses which is less than said minimum number; and pulsing predetermined heating elements not being used to eject droplets with electrical pulses insufficient in magnitude to vaporize ink when the number of droplet ejecting pulses are less than said minimum number to provide supplemental heat to the printhead which is equivalent to heat that would have been added by said determined number of droplet ejecting pulses which are less than said minimum number, so that the printhead is maintained at a substantially constant operating temperature, while the printhead is in the printing mode, without the need of continually sensing the printhead temperature.

2. The method of claim 1, wherein the method further comprises the step of identifying the heating elements used to eject droplets during said predetermined time period, in addition to the counting of the droplet ejecting electrical pulses, and determining those heating elements infrequently used to eject droplets; and wherein said predetermined heating elements pulsed with electrical pulses insufficient in magnitude to vaporize ink are those heating elements determined to be infrequently used to eject droplets during said printing by the printhead.

3. The method of claim 1, wherein the method further comprises the step of determining a number and a width of each of the electrical pulses insufficient in magnitude to vaporize ink which are to be used to pulse said predetermined heating elements.

4. The method of claim 4, wherein the width of the electrical pulses insufficient in magnitude to vaporize ink is established so that the predetermined heating elements pulsed therewith are all heating elements not ejecting droplets.

5. The method of claim 4, wherein the method further comprises the steps of providing a heat sink for the printhead with a known heat dissipating capacity; and periodically establishing an ambient temperature of a location within the vicinity of the printhead to establish a reference parameter which is used in conjunction with the counted droplet ejecting electrical pulses to determine the number and width of the electrical pulses insufficient in magnitude to vaporize ink without the need to continually check the printhead temperature or estimate thereof.

6. An improved thermal ink jet printhead of the type having an ink supply manifold, a plurality of capillary-filled, parallel ink channels that communicate at one end with the manifold and terminate at the other end with a nozzle, and a linear array of heating elements, one located in each ink channel, the printhead ejecting ink droplets on demand by the selective energization of the heating elements with electrical energy pulses having sufficient magnitude to vaporize instantaneously the ink in contact with the energized heating element, so that temporary vapor bubbles are formed which eject said ink droplets, wherein the improvement comprises:

means for counting a number of electrical energy pulses which ejected ink droplets during predetermined time periods;

means for comparing the counted number of electrical energy pulses which ejected ink droplets during said predetermined time periods with a minimum number of such pulses that are required to maintain the printhead operating temperature substantially constant; and energization of predetermined heating elements with electrical energy pulses insufficient i magnitude to vaporize the ink at times when said predetermined heating elements are not being energized for the ejection of ink droplets but concurrently when other heating elements are ejecting ink droplets to provide supplemental heat to the printhead, whenever the minimum number of droplet ejecting pulses is not met, so that the printhead is maintained at a substantially constant operating temperature while the printhead is in a printing mode without the need for continually sensing the printhead temperature.

7. The printhead of claim 6, wherein the printhead further comprises means for identifying the heating elements used to eject droplets during said predetermined time period and determining the heating elements most infrequently used.

8. The printhead of claim 7, wherein the printhead further comprises means for determining a number and a width of the energy pulses which are insufficient in magnitude to vaporize the ink; and wherein the heating elements determined to be most infrequently used to eject droplets are pulsed with the determined number of energy pulses with the determined pulses widths, which are each insufficient in magnitude to vaporize ink, so that the heating elements are pulsed more equally to provide more predictable heating element lifetimes.

9. The printhead of claim 6, wherein the predetermined heating elements are all heating elements not ejecting droplets are pulsed with energy pulses insufficient in magnitude to vaporize the ink to provide supplementary heat to the printhead.

10. The printhead of claim 9, wherein an ambient temperature in the vicinity of the printhead is periodically sensed to establish a reference parameter from which a number and w width of energy pulses insufficient in magnitude to vaporize the ink are established.

11. The printhead of claim 10, wherein said periodic sensing of the ambient temperature is done at a time when the printhead enters a printing mode and again after the printing of each page of information by the printhead.

12. A thermal ink jet printhead for use in an ink jet printer and of the type having a plurality of fully functional printhead subunits mounted on a structural bar, each printhead subunit having a linear array of equally spaced nozzles and a heating element for each nozzle, the printhead subunits being equally spaced from a recording medium and adapted to eject ink droplets on demand from selected nozzles in response to electrical energy pulses representative of data to be printed, which are applied to the heating elements of each printhead subunit, comprising:

means for counting a number of droplet ejecting electrical energy pulses applied to the heating elements of each respective subunit which ejects ink droplets from nozzles therein during predetermined time periods;

means for comparing each of the counted number of electrical energy pulses which ejected ink droplets during said predetermined time periods with a minimum number of such pulses that are required to maintain each printhead subunit operating temperature substantially constant and determining a number of droplet ejecting electrical energy pulses which are less than said minimum number of such pulses; and energization of predetermined heating elements in each printhead subunit not being used to eject droplets with subthreshold energy pulses insufficient in magnitude to vaporize ink to provide supplemental heat to the printhead subunits which is equivalent to heat that would have been added by said determined number of droplet ejecting electrical energy pulses which are less than said minimum number, in order to maintain all of the printhead subunits within the desired operating temperature.

13. The printhead of claim 12, wherein the printhead further comprises:

means for periodically sensing the temperature of the structural bar, so that a reference temperature may be determined for use in determining the predetermined heating elements in each printhead which shall have subthreshold energy pulses applied thereto without the need of individual temperature sensors on each printhead subunit.

14. The pagewidth printhead of claim 13, wherein the means for periodically sensing the temperature of the structural bar is via a temperature sensor mounted thereon, the periodic sensing being accomplished at start of printing and after each page of printing is completed on a page of recording medium.

15. The printhead of claim 13, wherein the printhead contains a quantity of printhead subunits mounted along the structural bar sufficient to produce a pagewidth printhead capable of printing at least one line of pixels across the width of one page.

16. The printhead of claim 15, wherein the pagewidth printhead is fixed and the recording medium is moved thereby at a constant velocity.

17. The printhead of claim 16, wherein the pagewidth printhead further comprises means for determining the quantity and pulse width of the subthreshold pulses.

18. The printhead of claim 16, wherein all of the heating elements of each subunit are pulsed with either a droplet ejecting pulse or a subthreshold pulse for supplemental heating during the printing mode.

19. A method of maintaining a desired operating temperature of a printhead in a thermal ink jet printer substantially constant, the printhead having a plurality of nozzles and a heating element for each nozzle, and the printer having a controller for selectively applying either droplet ejecting or non-droplet ejecting electrical pulses to the printhead heating elements, so that, when the printhead is in a printing mode, the printhead is capable of ejecting ink droplets from the nozzles having satisfactory velocities in response to droplet ejecting electrical pulses applied to selected heating elements, comprising the steps of:

(a) providing a heat sink for the printhead having a known rate of heat dissipation to remove heat continually from the printhead;

(b) counting droplet ejecting electrical pulses applied to the printhead heating elements during a predetermined time period, each droplet ejecting electrical pulse adding a first known amount of heat energy to said printhead;

(c) comparing the counted droplet ejecting electrical pulses with a minimum number thereof required to maintain the desired printhead operating temperature constant, while said heat sink is dissipating heat, and deriving a number of such pulses which are less than said required minimum number;

(d) determining a number of non-droplet ejecting pulses required to maintain the desired operating temperature of the printhead, when the counted droplet ejecting pulses are less than the minimum number required, each non-droplet ejecting pulse adding a second known amount of heat energy to the printhead; and (e) applying said determined number of non-droplet ejecting pulses to the printhead heating elements in nozzles not being used to eject droplets, so that the printhead is maintained at a substantially constant operating temperature without the need of continually sensing the printhead temperature.

20. The method of claim 19, wherein the determined number of non-droplet ejecting pulses applied to the printhead heating elements during step (e) are applied to all heating elements not being used to eject droplets, so that each heating element is being pulsed with either a droplet ejecting pulse or a non-droplet ejecting pulse.

21. The method of claim 19, wherein the determined number of non-droplet ejecting pulses applied to the printhead heating elements during step (ea) are applied to predetermined heating elements not being used to eject droplets.

22. The method of claim 21, wherein the method further comprises the steps of:

(f) identifying the heating elements in step (b) which are used to eject droplets and generating a signal indicative thereof;

(g) averaging the use of each of said identified heating elements;

(h) storing the signal indicative of the identified heating elements and their average use in a data base; and (i) using the data base to select the least used heating elements for application of the non-droplet ejecting pulses in step (e) in order to average out the overall number pulses of per heating element to increase the life time of the printhead.

23. The method of claim 21, wherein the method further comprises the step of: periodically sensing a temperature of a location within the vicinity of but spaced from the printhead to establish a reference parameter for use by the controller at predetermined periodic time s to establish, in conjunction with the known rate of heat dissipating of said heating sink, the pulse widths of the non-droplet ejecting pulses.

* * * * *